US007296704B2

(12) United States Patent
Ferrini

(10) Patent No.: US 7,296,704 B2
(45) Date of Patent: Nov. 20, 2007

(54) COLLAPSIBLE CONTAINER

(76) Inventor: Jonathan B. Ferrini, P.O. Box 38, La Jolla, CA (US) 92038

( * ) Notice: Subject to any disclaimer, the term of this patent is extended or adjusted under 35 U.S.C. 154(b) by 0 days.

(21) Appl. No.: 10/916,358

(22) Filed: Aug. 11, 2004

(65) Prior Publication Data

US 2006/0043090 A1 Mar. 2, 2006

(51) Int. Cl.
*B65D 6/22* (2006.01)
*B65D 88/52* (2006.01)
*B65D 88/58* (2006.01)

(52) U.S. Cl. ..... 220/1.5; 220/4.29; 220/4.34; 220/6

(58) Field of Classification Search ..... 220/1.5, 220/4.28, 4.29, 6, 4.34; 217/15, 47
See application file for complete search history.

(56) References Cited

U.S. PATENT DOCUMENTS

| | | | | |
|---|---|---|---|---|
| 1,198,524 | A | 9/1916 | Cunliffe | |
| RE14,471 | E | 5/1918 | Doble et al. | |
| 1,268,715 | A | 6/1918 | Hoffman | |
| 1,651,284 | A | 11/1927 | Leiberman | |
| 2,530,148 | A | 11/1950 | Bjorklund et al. | |
| 2,560,089 | A | 7/1951 | Cottingham | |
| 2,989,226 | A * | 6/1961 | Swartz | 229/125.19 |
| 3,398,850 | A * | 8/1968 | Kennard | 220/6 |
| 3,403,806 | A * | 10/1968 | Pohl | 220/6 |
| 3,814,220 | A | 6/1974 | Brody | |
| 4,099,640 | A | 7/1978 | Nessfield et al. | |
| 4,222,662 | A * | 9/1980 | Kruegle | 355/40 |
| 4,662,532 | A | 5/1987 | Anderson et al. | |
| 4,674,647 | A | 6/1987 | Gyenge et al. | |
| 4,735,331 | A | 4/1988 | Keenan et al. | |
| 4,914,874 | A * | 4/1990 | Graham, Jr. | 52/79.1 |
| 4,993,574 | A * | 2/1991 | King et al. | 220/1.5 |
| 5,601,202 | A * | 2/1997 | Meacham et al. | 220/6 |
| 6,006,918 | A * | 12/1999 | Hart | 206/600 |
| 6,170,689 | B1 * | 1/2001 | Flesher et al. | 220/7 |
| 6,401,995 | B1 | 6/2002 | Yuille et al. | |
| 6,405,888 | B1 * | 6/2002 | Overholt et al. | 220/6 |
| 6,679,507 | B1 * | 1/2004 | Ahm | 280/79.3 |
| 6,684,760 | B1 * | 2/2004 | Rajusth | 99/449 |
| 6,691,885 | B2 | 2/2004 | Brown | |
| 6,726,046 | B2 | 4/2004 | Orset | |
| 6,749,077 | B1 * | 6/2004 | McAlpine et al. | 220/4.29 |
| 6,820,761 | B1 * | 11/2004 | Mouri et al. | 220/6 |
| 2003/0047610 | A1 * | 3/2003 | Selinfreund et al. | 235/454 |
| 2003/0137968 | A1 * | 7/2003 | Lareau et al. | 370/349 |
| 2004/0222222 | A1 * | 11/2004 | Parnall et al. | 220/6 |
| 2005/0000961 | A1 * | 1/2005 | Hilders | 220/4.28 |
| 2005/0077292 | A1 * | 4/2005 | Devine | 220/6 |
| 2005/0151067 | A1 * | 7/2005 | Beinhocker | 250/227.15 |

* cited by examiner

*Primary Examiner*—Anthony D. Stashick
*Assistant Examiner*—Niki M. Eloshway

(57) ABSTRACT

A collapsible container is equipped with a global positioning system and a radio transmitter to ease in locating the container when lost. The collapsible container includes some reflective means or bright coloration such that it is easily seen upon open waters. The container may include means for recording when the container has been opened and closed. The container is sealed and substantially water-tight and is made up of interchangeable sections including a bottom, at least one side panel capable of collapsing, a top panel, and at least one door.

21 Claims, 10 Drawing Sheets

COLLAPSIBLE CONTAINER

BACKGROUND

1. Field of the Invention

The present invention relates to containers, and more specifically to a collapsible shipping container made of light, strong and durable materials. This invention may also be used in other embodiments as a collapsible refuse receptacle for municipalities or individuals. It may also be used as a general-purpose storage container.

2. Background of the Invention

Intercontinental shipping containers are designed to be large, cumbersome and bulky. These seemingly negative traits have often been seen as beneficial in the long-haul shipping industry. The individual or company that is shipping the goods desires to have as large a capacity as possible for their goods. The shipper desires to have the ability to fill its bulkhead quickly with cargo by using standard-sized containers positioned by cranes and other handling equipment.

The large capacity and the standardization in size of the shipping containers are a benefit. However, when not in use or once emptied the large size and bulky nature of these containers is a serious issue. The storage of these containers when not in use has been accomplished until now by stacking the containers near the shipping area. The containers are not safe above a certain height, therefore they are stacked generally less than ten high. The containers are then placed next to each other taking up far more space than is necessary.

The standardization as bulky and heavy also serves to make the containers in the prior art unsuitable for buoyancy. The present invention improves over the prior art by ensuring that the material is light enough to allow the collapsible container to float. Each hinge, joint and door frame in the collapsible container are sealed against water. Therefore, the collapsible container, when in its fully erect state is completely water-tight and will float if dropped into a large body-of water. This will keep the goods safe while providing time to find the floating container.

It is therefore an object of this invention to provide a means by which containers may retain the features of standard size, large capacity, durability, and strength while further providing the ability to collapse the container when not in use to a considerably smaller size for easy storage. It is an additional object of this invention to provide containers that are buoyant and can be spotted floating on the water at night. It is another object of this invention to provide means by which the containers may be tracked locally and globally. These and other objectives of the present invention will become apparent from the following description of the invention.

SUMMARY OF THE INVENTION

A collapsible container is equipped with a global positioning system and a radio transmitter to ease in locating the container when lost. The collapsible container includes some reflective means or bright coloration such that it is easily seen upon open waters. The container may include means for recording when the container has been opened and closed. The container is sealed and substantially water-tight and is made up of interchangeable sections including a bottom, at least one side panel capable of collapsing, a top panel, and at least one door.

DETAILED DESCRIPTION OF THE INVENTION

The present invention provides an apparatus for use as a container that is collapsible for easy storage. In the following description, specific components and makeup are described in order to give a more thorough understanding of the present invention. In other instances, well-known elements such as the details of various construction materials are not described in detail so as not to obscure the present invention unnecessarily.

Figure 1:
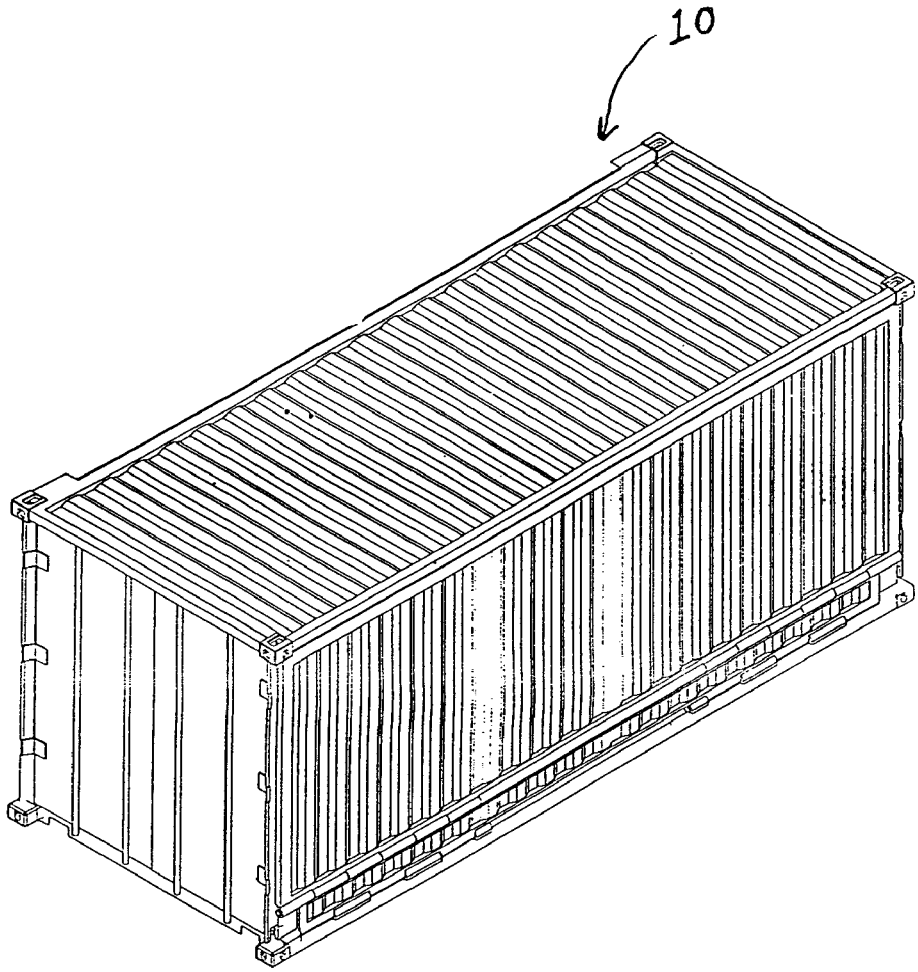
FIG. 1 is the container in its full-erected position.

Referring first to FIG. 1, the collapsible container 1 is depicted in its fully erected position. In the preferred embodiment the container is made of a durable, strong and light material. The material is sufficiently durable to last for several years of use. The material is strong enough to support the types of goods that will be shipped within the container. Finally, the material is as light as possible while still maintaining the prior two attributes. This will enable the shipping vessel to hold as many of the containers as possible. Steel is the most common material used in the prior art and is acceptable for use in the present invention. Reinforced aluminum may also be used. Alternative materials that are necessary for alternative objects will be mentioned below.

Figure 2:
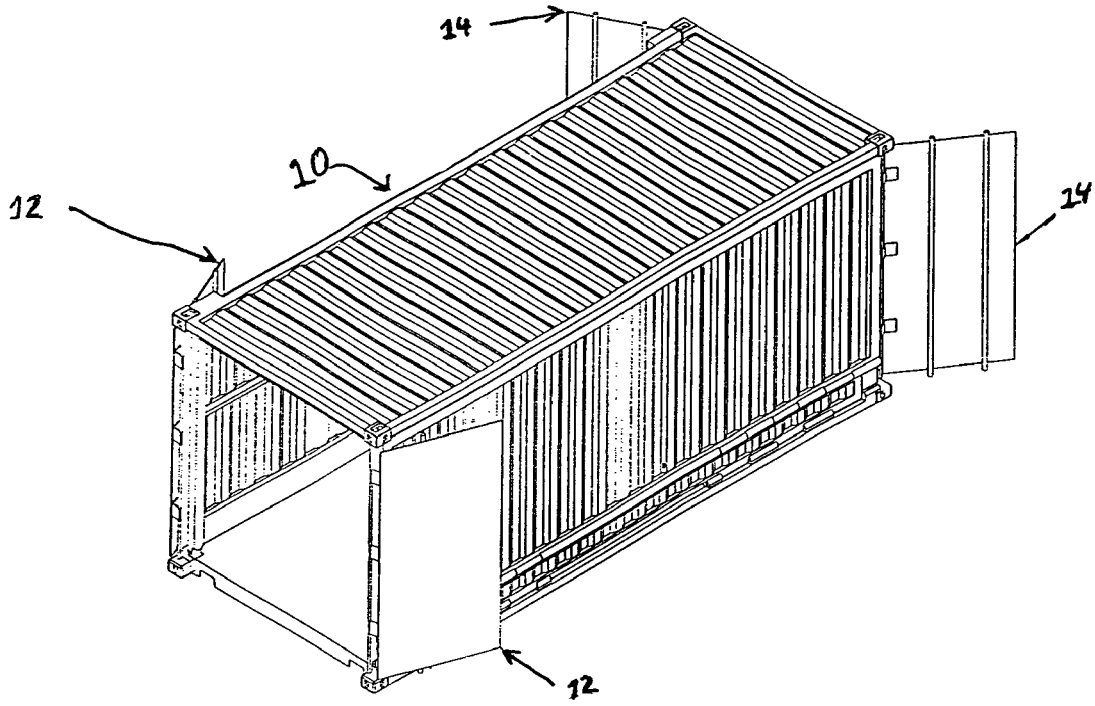
FIG. 2 is the container with the front and rear doors open.

Referring next to FIG. 2, the collapsible container 1 is depicted with its front doors 12 and rear doors 14 open. Doors to the container are available at both ends to ease in quickly loading the container. These front doors 12 and rear doors 14 may be affixed with a locking mechanism. In the preferred embodiment, there are seals around the doors that keep the container water-tight. The hinges on the front doors 12 and the rear doors 14 are of the pin-rod type. The doors may be completely removed and replaced by taking out the pin-rod that makes up the hinge of the door. The doors are also interchangeable so that the end-user could replace a container with a damaged door by simply replacing the door. All panels are equipped with water-tight seals as well.

Figure 3:
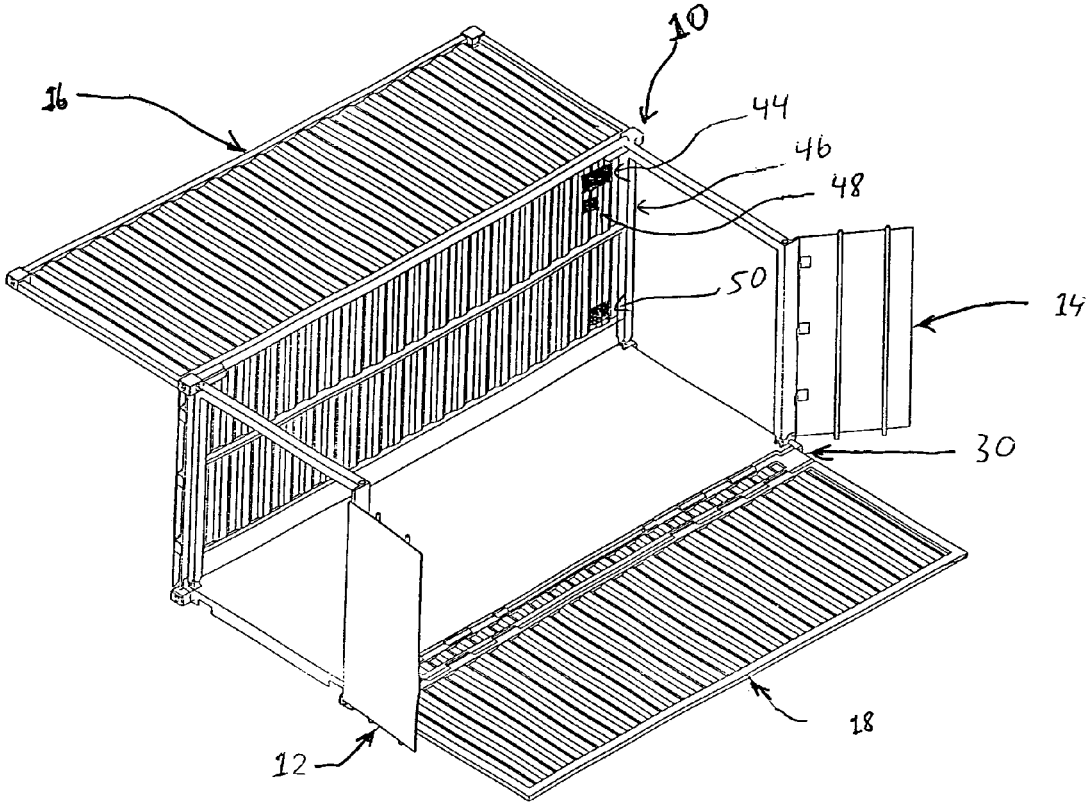
FIG. 3 is the container in the fully open position.

Referring next to FIG. 3, the collapsible container 1 is depicted completely open. The top panel 16 is hinged using the same pin-rod method as the front doors 12 and rear doors 14. The side panel 18 is also hinged and is open. This configuration of the container will allow for quick and easy loading from all sides. Alternatively, only one of top panel 16 and side panel 18 may be opened such that quick side-loading may take place or quick top-loading. Also depicted is sub-wall 30. This sub-wall 30 enables the user to open the container completely for easy loading, such as with a forklift. Additionally, when this sub-wall 30 is maintained in its upright position, the side panel 18 may be folded inward to begin the collapsing function.

Figure 4:
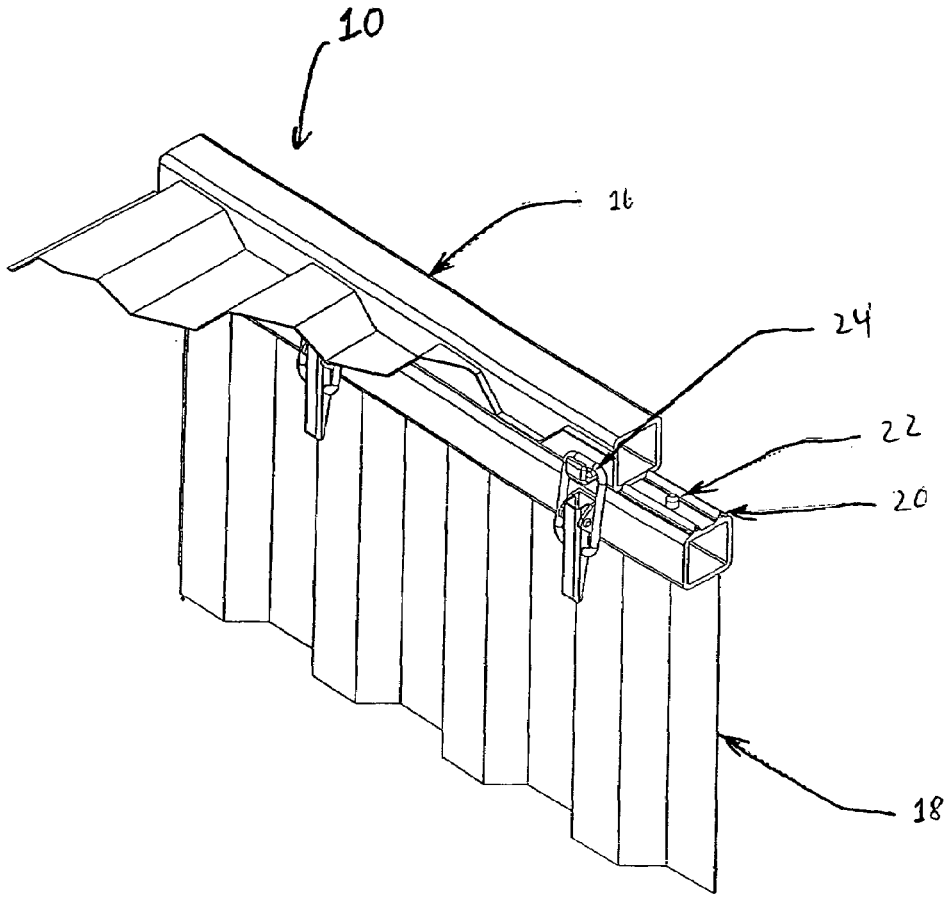
FIG. 4 is a detail of the roof latching mechanism.

Referring next to FIG. 4, the latching mechanism 24 of the collapsible container 1 is depicted. A portion of the top panel 16 is depicted as a cut-away to allow viewing of the latching mechanism 24. Also depicted are the guide pins 22 to help ensure that the main wall does not fall without warning. There is also an airtight seal 20 depicted between the top panel 16 and side panel 18. This will help enable the collapsible container to float, should it somehow end up in water. This is a significant advancement over the prior art. Using the prior art, if a container is swept or slipped overboard during ocean shipping, the container and its cargo is lost. However, using the present invention, equipped at each joint with airtight seals 20, the collapsible container 1 will be able to float. The exact method of manufacture of the latches 24 will be well known to those skilled in the art. The latches 24 may be of a type that locks into place by means of a pin or bolt. The latches 24 are capable of holding the top panel 16 in place, without slipping, and substantially tightly enough to enable the airtight seals 20 to perform the function of sealing the container from air and outside liquid.

One of the objects of the airtight seals 20 is to enable the container to float. In an ocean-shipping scenario, once the collapsible container 1 of the present invention is swept overboard, it would remain floating until discovered or until swept onto land. For this reason, the materials used to make the collapsible container 1 may also be painted or the materials used may be chemically designed to be very bright colors. In the preferred embodiment, the collapsible container 1 is fluorescent in color, illuminating when a light is shined upon it. Alternatively, the container may be brightly colored or be affixed with various reflectors designed to brightly reflect light back to a searching aircraft or ship.

Referring again to FIG. 3, the collapsible container may be affixed internally with a global positioning system (GPS) receiver and a transmitter 44. While floating on the water, an individual with the proper identification for the collapsible container could request a location of an individual collapsible container. The container would be able to use the GPS to determine exactly where it is within several feet and could transmit, using the antenna 46 this information on a set frequency to a nearby searching aircraft or ship. In the preferred embodiment, the antenna 46 would be embedded in a side-wall of the collapsible container 1. This would allow someone with the proper frequency to locate the container anywhere in the world. Because the container is designed to be water-tight, this would allow a searching party to quickly find the container floating in a large body of water.

Additionally, the GPS 44 could be used to quickly locate a container and the contents of that container anywhere throughout the world. Using a cross-reference to the goods inside, the shipper, recipient and other data elements in conjunction with this GPS would enable international authorities to locate items related to a terrorist plot anywhere in the world. For example, should a plot be discovered subsequent to a ship leaving port, the materials on board could be found, anywhere in the world, in a matter of seconds. The GPS 44 may even be used to distinguish the individual container from other containers nearby. This would allow the proper authorities to find and dispose of the hazardous materials as quickly as possible. GPS 44 may also be used in conjunction with a data storage medium, embedded in the container or GPS 44 implementation itself or through the use of a ship or internet database to keep an up-to-date record of the locations, throughout the world, where the container has been within the past week, month or year.

The collapsible container may also be equipped with a small Radio Frequency (RF) transmitter 48 that contains a unique identification for that container. This unique identification would be cross-referenced, prior to embarking on the shipping voyage, with the goods contained within that collapsible container. Therefore, at any point, the crew of the ship could quickly determine which goods were in which container in which portion of the ship. This would enable the crew to keep better track of the cargo on the ship and where each piece of cargo, for example if there were multiple stops, was supposed to be unloaded. This may be further overlaid with an RF implementation for each individual piece of cargo within each collapsible container 1.

In the preferred embodiment, the container is also equipped with a sensor and recording device 50 capable of monitoring at what points in time the container has been opened. This recording device may be integrated with the antenna 46 to enable the recording device 50 to update a database on board the shipping vessel as to when the container have been opened and closed. This capability would alert a ship's captain, for example, of tampering with the cargo after leaving port or sometime after the container has been closed at the shipping point.

In the preferred embodiment, the collapsible container 1 would also be made of a material that was capable of quick inspection by an individual. The preferred material would ordinarily be opaque, but when a particular type of light, such as ultraviolet (UV) light is shined upon the containers; they become at least partially transparent enabling an individual to inspect the contents quickly without having to open the container. Alternatively, the containers may simply be made of material that is somewhat translucent. Alternatively, the collapsible container 10 may be made of material that is x-ray penetrable. Alternatively, the collapsible container 10 may be made of a material that is penetrable by other means of inspecting, searching or viewing the contents of the collapsible container 10. Each of these example embodiments are designed to enable fast and simple inspection of the inside of the collapsible container 10, for example, by customs officials as a shipment of cargo is unloaded for distribution at a port.

Thus, this invention will enable a customs official at a port to quickly and actually inspect all of the containers of this type in a considerably shorter amount of time than has previously been available in the prior art. This is a considerable addition to national counter-terrorism efforts. The ability to more easily protect the public by actually inspecting many or most of the containers entering at a port if necessary will be a considerable aid in any effort to combat terrorism.

The container may collapse when in storage at a port. This feature of the present invention not only allows space to be saved at the port, while the containers are not in use; but also aids in protecting a port from attack. The empty collapsed containers cannot be used to store explosives or other harmful material in the port without fully erecting the collapsible container. The few, if any, non-empty collapsible containers at port will more easily be inspected than dozens of empty containers of the present art. The lack of empty, hidden spaces to store materials on the dock may not only hinder harmful activities such as terrorist activities, but more readily aid in stopping other contraband from entering the country through ports.

Figure 5:
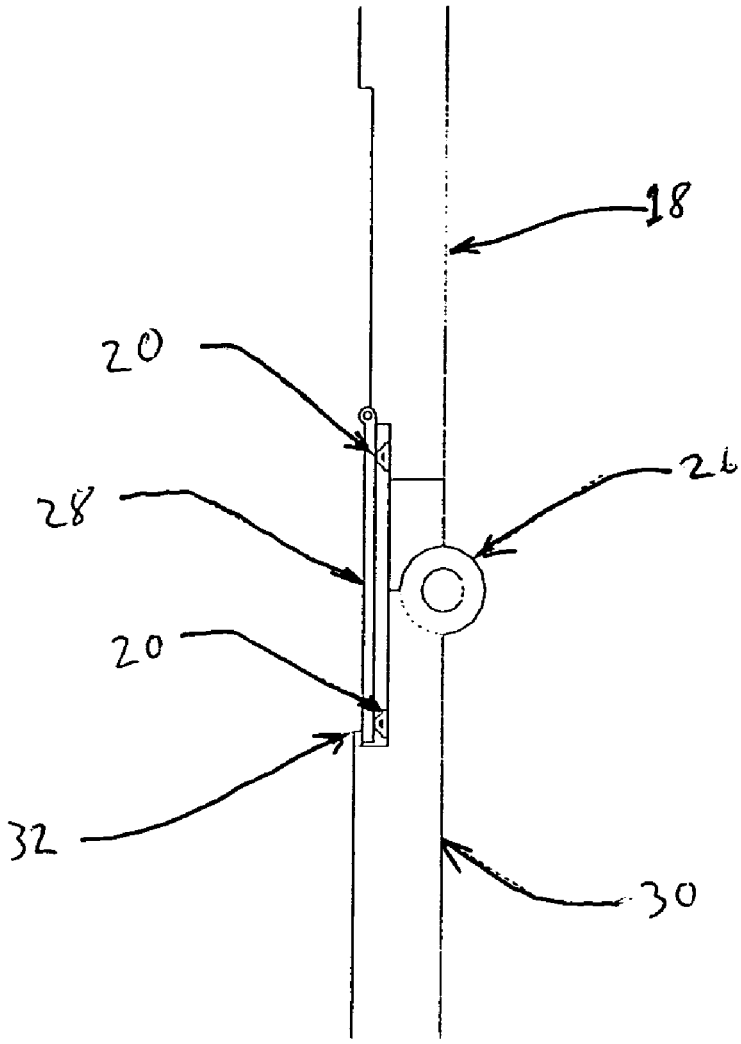
FIG. 5 is a cross-sectional view of the main wall hinge and airtight seal.

Referring next to FIG. 5, a cross-sectional view of the hinge mechanism is depicted. The side panel 18 of the back wall is depicted. Side panel 18 is divided into two sections, with the sub-wall 30 being the lower section. There is a hinge 26 at the mid-point to enable this container to collapse. This hinge runs for the length of side panel 18. Covering the outside of the hinge, when the collapsible container 10 is in its non-collapsed position, is weather seal cover 28. This weather seal cover 28 is designed to provide surface area over the hinge 26 and the two airtight seals 20. This surface area will enable the two airtight seals to maintain a seal against outside air and liquid. To keep the weather seal cover in place the weather seal latch 32 is set on the lower outside of the hinge. This latch clips over the weather seal cover 28 to ensure a tight fit with the two airtight seals 20. The weather seal cover 28 is affixed to the upper portion of the side panel 18 by means of its own hinge arranged such that when the weather seal latch is holding the weather seal cover 28 in place, the weather seal cover 28 will fit tightly against the upper airtight seal 20. The weather seal latch 32 ensures that the weather seal cover 28 fits tightly against the lower airtight seal 20.

The hinge 26 is substantially near the bottom of the side where side panel 18 is situated and is configured in such a way that it will allow the upper portion of side panel 18 to fold inward until it is substantially perpendicular to the bottom of the collapsible container 1. The weather seal cover 28, when the collapsible container 10 is or is being collapsed will fit neatly against the upper portion of side panel 18 in a small cut-away section of the upper portion of side panel 18. The weather seal cover 28 may even be affixed with an internal spring system such that, once the weather seal latch 32 is undone, the weather seal cover 28 will spring to this position against the upper potion of side panel 18.

Figure 6:
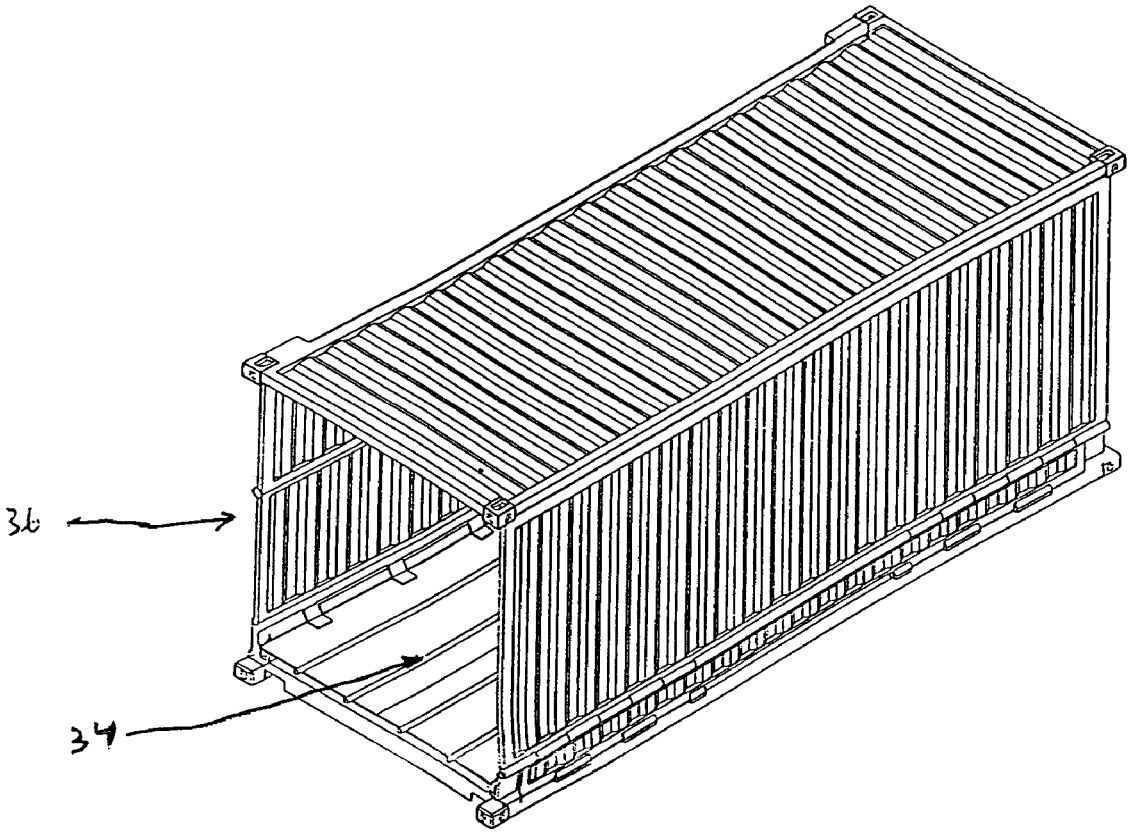
FIG. 6 is the container with the end doors removed for collapsing.

Referring next to FIG. 6, substantially the same hinge mechanism as in FIG. 5 is used on the mid-point of the side panel 36. This hinge mechanism will enable the upper portion of the side panel 36 to fold outward until it is substantially perpendicular to the lower portion of side panel 36. Then, the hinge at the base of side panel 36, also sealed and substantially similar to that as described in FIG. 5 will allow side panel 36 to fold inwards until it is substantially perpendicular to the container bottom 34. This process will be described in more detail below.

Figure 7:
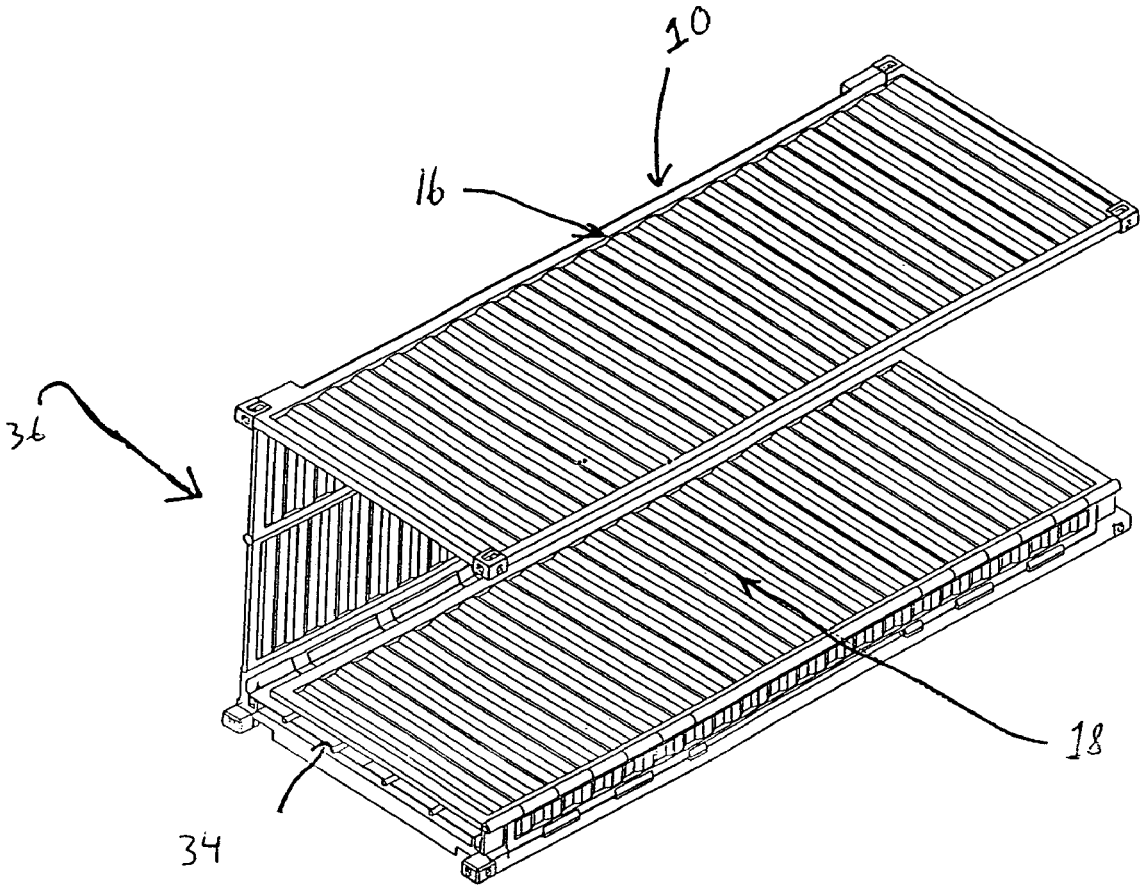
FIG. 7 is the container with one side collapsed onto the bottom of the container.

Referring next to FIG. 7, the description of the collapsing process begins with a depiction of the first step in collapsing the collapsible container 10. The first step is to use the hinge 26 depicted in FIG. 5 to fold side panel 18 into the collapsible container until it is substantially perpendicular to the container bottom 34. The next step is to fold the side panel 36 in on itself and down. Once this is completed, side panel 36 will be folded in half and substantially perpendicular to side panel 18, which is now lying on the container bottom 34. Finally, top panel 16 will be collapsed along with side panel 36 and will be resting on top of the folded side panel 36, substantially perpendicular to the folded side panel 36.

Figure 8:
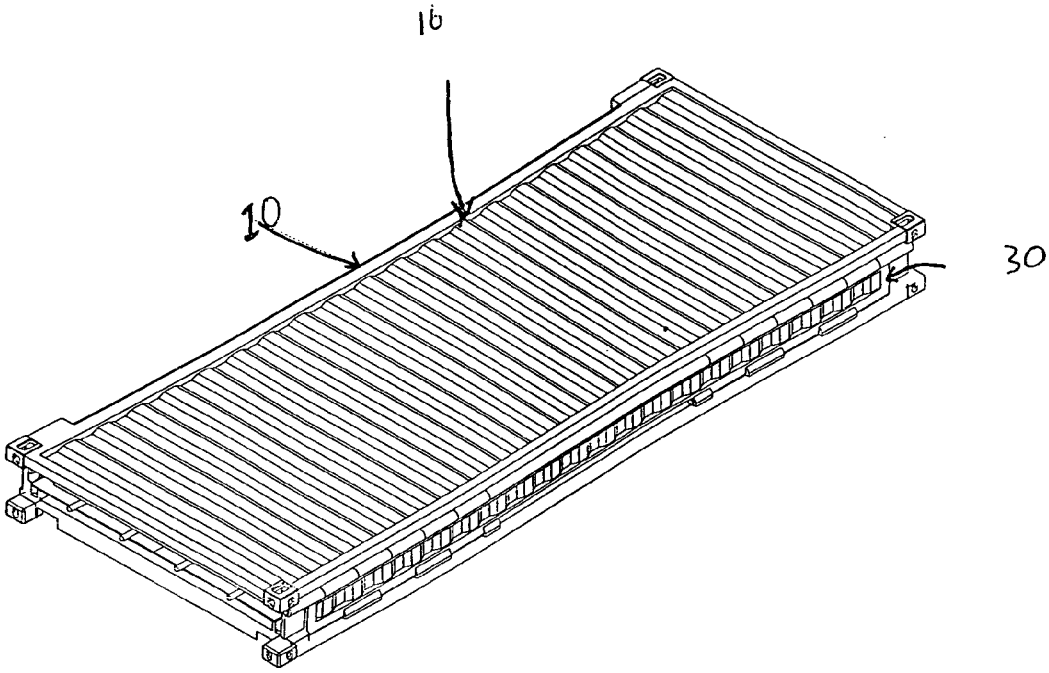
FIG. 8 is the container fully collapsed.

Referring next to FIG. 8, the collapsible container 10 is depicted in its completely collapsed state. The top panel 16 is substantially perpendicular to the container bottom 34. The collapsed height of the collapsible container 10 is roughly the height of sub-wall 30. In this collapsed state, the container will take up the same "foot print" as the non-collapsed version or of standard non-collapsible containers, but substantially less height. Several collapsed collapsible containers are now able to fit in the same area as one non-collapsed or non-collapsible container. In the preferred embodiment, small pin-rods or other means are employed to "lock" the collapsible container in its collapsed state. This will ease in handling, transportation and storage of the collapsible container 10.

Figure 9:
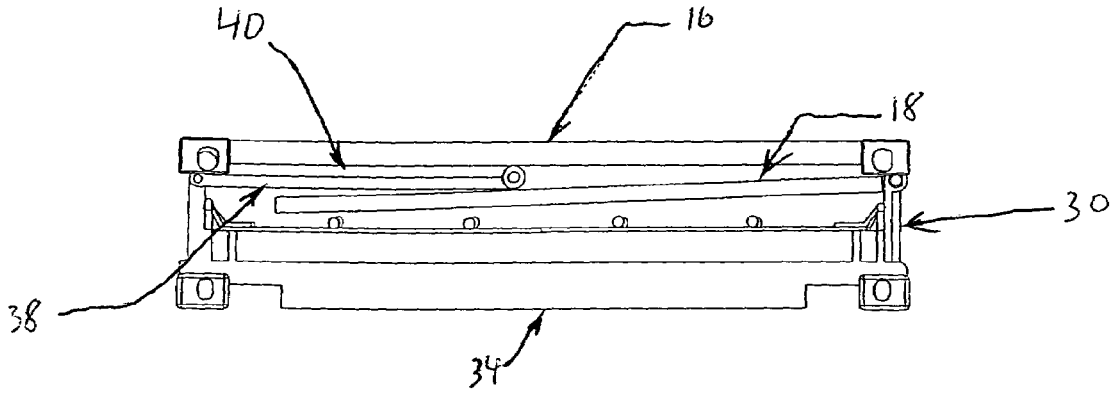
FIG. 9 is a cross sectional view of the container fully collapsed.

Referring next to FIG. 9, a completely collapsed collapsible container 10 is depicted from a different perspective. In this perspective, the top panel 16 is still visible and the sub-wall 30 is also visible. More clearly visible in this depiction are the upper 40 and the lower portion 38 of side panel 36 from FIG. 6. Side panel 18 is collapsed inward onto container bottom 34. Upper 40 is collapsed outward and down onto lower portion 38 and lower portion 38 is collapsed inward and onto side panel 18. The top panel 16, still attached by means of a hinge to upper 40 is lowered onto upper 40, substantially perpendicular to the container bottom 34.

Figure 10:
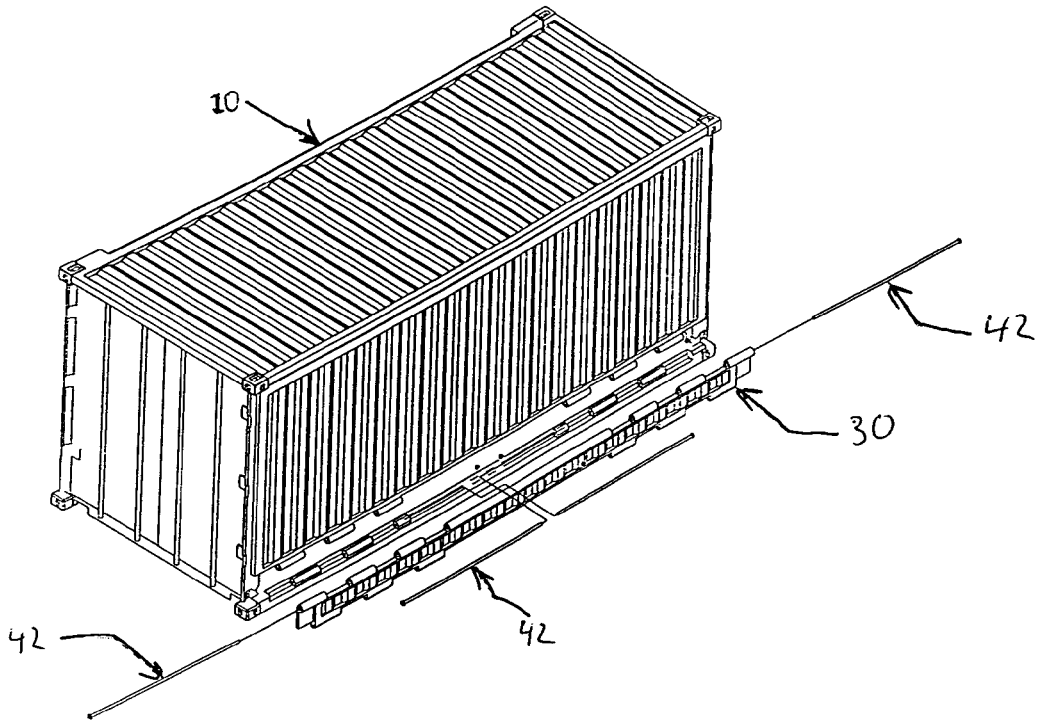
FIG. 10 is a depiction of the pin-rod hinge of the container sections and a wall being removed for replacement.

Referring next to FIG. 10, the pin rod system for attaching each door and panel is depicted. Sub-wall 30 is depicted as detached from the collapsible container 10. Pin rods 42 are used in attaching all side panels and doors. Each panel and door is substantially interchangeable such that a user can replace a damaged or worn panel with the same panel from any other collapsible container. Should several containers be damaged in various places, one or more collapsible containers could thus be constructed using their parts by users on the spot. In the preferred embodiment, the pin rods are capable of being locked in place by an additional pin or an internal locking mechanism so that they do not come lose or detach panels at random. To replace a damaged panel, the user need only find the same piece on another collapsible container 10 or to order the portion of a container needed. The damaged panel is removed by removing all of the pin rods 42 that hold it in place. The user then replaces the panel with a new or less damaged panel and puts the pin rods 42 back in place. The same procedure can be performed for any of the panels or doors using much the same method. This is a quick and easy way to repair the collapsible container.

The innovation of a collapsible container need not be isolated to use in ocean shipping and transport. The collapsible container may be used as upper portions of train transport cars, semi-trailer truck trailers, or in various aircraft shipping and transportation containers.

Additionally, the same type of container may have broad application in municipalities as refuse or recycling receptacles. When put to such a use, the collapsible container would likely have a slightly modified lid to allow access for discarding refuse. The container may be affixed with wheels to enable a large trash truck to move the container for picking up. The collapsible container may have attachments to enable a trash truck to pick up the collapsible container.

The collapsible container may have application for the commercial user. In the large and in smaller variations of the same device, the container would be an idea storage device capable of easy storage itself. Smaller variations could be made for use in the home, garage, or office. In the preferred embodiment, these variations would be made of plastic. In alternative embodiments, these collapsible containers may be made from steel, aluminum, or other suitable strong and durable material.

Accordingly, a collapsible container has been described. It is to be understood that the foregoing description has been made with respect to specific embodiments thereof for illustrative purposes only. The overall spirit and scope of the present invention is limited only by the following claims, as defined in the foregoing description.

What is claimed is:

1. A collapsible ocean-going shipping container comprising:

a solid bottom;

a first side panel, hingedly attached perpendicular to said bottom;

a second side panel, hingedly attached to said first side panel by means of a pin rod hinge;

a third side panel, opposite from said first side panel, hingedly attached to said bottom, comprising:

a. a fourth side panel, hingedly attached to said bottom; and b. a fifth side panel, hingedly attached to said fourth side panel;

a top, hingedly attached to said fifth side panel and detachably affixed to said second side panel to thereby form a rectangular cylindrical enclosure;

a first set of removable doors, hingedly attached to one end of said rectangular cylindrical enclosure;

a second set of removable doors, hingedly attached to the opposite end of said rectangular cylindrical enclosure;

wherein, once said first and second sets of removable doors are removed, said second panel collapses inward while said first side panel remains perpendicular to said bottom, said fourth side panel collapses inward, said fifth side panel collapses inward and said top collapses downwards to thereby collapse the collapsible ocean-going container; and wherein the collapsible ocean-going container is substantially watertight when not collapsed.

2. The collapsible container of claim 1, wherein each of said bottom, said top and said second and third side panels are attached, as described in claim 1, utilizing latches.

3. The collapsible container of claim 1, wherein each of said first, second, third, fourth and fifth side panels, said top panel, said bottom panel, and said first and second set of removable doors are interchangeable with replacements.

4. The collapsible container of claim 1, wherein said collapsible container is further comprised of a global positioning system.

5. The collapsible container of claim 4, wherein said collapsible container is further comprised of a device for maintaining a record of the global position of the collapsible container for a set period of time.

6. The collapsible container of claim 4, wherein said collapsible container is further comprised of a device for transmitting a record of the global position of the collapsible container to an external data storage for a set period of time.

7. The collapsible container of claim 1, wherein said collapsible container is further comprised of a transmitter.

8. The collapsible container of claim 1, wherein said collapsible container is manufactured using aluminum.

9. The collapsible container of claim 1, wherein said collapsible container is manufactured using plastics.

10. The collapsible container of claim 1, wherein said collapsible container is manufactured using steel.

11. The collapsible container of claim 1, wherein said collapsible container is used as a refuse receptacle.

12. The collapsible container of claim 1, wherein said collapsible container is further comprised of at least one wheel.

13. The collapsible container of claim 1, wherein said collapsible container is further comprised of an apparatus designed for use by a garbage collection truck.

14. The collapsible container of claim 1, wherein said collapsible container is used as a storage container.

15. The collapsible container of claim 1, wherein said collapsible container is small enough for residential use.

16. The collapsible container of claim 1, wherein said collapsible container is large enough for use in intercontinental shipping.

17. The collapsible container of claim 1, wherein said collapsible container is further comprised of a device for monitoring and recording the times at which said collapsible container has been opened and closed.

18. The collapsible container of claim 17, wherein said collapsible container is further comprised of a device for transmitting said recorded times at which said collapsible container has been opened and closed to a database.

19. The collapsible container of claim 1, wherein said collapsible container is further comprised of a barcode label.

20. A collapsible ocean-going shipping container comprising:

a solid bottom;

a first side panel, hingedly attached perpendicular to said bottom;

a second side panel, hingedly attached to said first side panel by means of a pin rod hinge;

a third side panel, opposite from said first side panel, hingedly attached to said bottom, comprising:

a. a fourth side panel, hingedly attached to said bottom; and b. a fifth side panel, hingedly attached to said fourth side panel;

a top, hingedly attached to said fifth side panel and detachably affixed to said second side panel to thereby form a rectangular cylindrical enclosure;

a first set of removable doors, hingedly attached to one end of said rectangular cylindrical enclosure;

a second set of removable doors, hingedly attached to the opposite end of said rectangular cylindrical enclosure;

a global positioning system receiver located within the container;

recording means located within the container responsive to said global positioning system for maintaining a record of the position of the container during a predetermined period of time;

a radio frequency transmitter located within the container; wherein, once said first and second sets of removable doors are removed, said second panel collapses inward while said first side panel remains perpendicular to said bottom, said fourth side panel collapses inward, said fifth side panel collapses inward and said top collapses downwards to thereby collapse the collapsible ocean-going container; and wherein the collapsible ocean-going container is substantially watertight when not collapsed.

21. A collapsible ocean-going shipping container comprising:

a solid plastic bottom;

a first plastic side panel, hingedly attached perpendicular to said bottom;

a second plastic side panel, hingedly attached to said first side panel by means of a pin rod hinge;

a third plastic side panel, opposite from said first plastic side panel, hingedly attached to said solid plastic bottom, comprising:

a. a fourth plastic side panel, hingedly attached to said bottom;

b. a fifth plastic side panel, hingedly attached to said fourth plastic side panel;

a plastic top, hingedly attached to said fifth plastic side panel and detachably affixed to said second plastic side panel to thereby form a rectangular cylindrical enclosure;

a first set of removable plastic doors, hingedly attached to one end of said rectangular cylindrical enclosure;

a second set of removable plastic doors, hingedly attached to the opposite end of said rectangular cylindrical enclosure;

wherein, once said first and second sets of removable plastic doors are removed, said second plastic panel collapses inward while said first side panel remains perpendicular to said bottom, said fourth side panel collapses inward, said fifth plastic side panel collapses inward and said plastic top collapses downwards to thereby collapse the collapsible ocean-going container; and wherein the collapsible ocean-going container is substantially watertight when not collapsed.

* * * * *